United States Patent [19]

Gilomen et al.

[11] 3,974,639

[45] Aug. 17, 1976

[54] DRIVING DEVICE FOR MECHANICAL TIMEPIECE MOVEMENTS

[75] Inventors: Beat Gilomen; Kurt Schaller, both of Lengnau, Switzerland

[73] Assignee: A. Schild S.A., Switzerland

[22] Filed: Sept. 23, 1975

[21] Appl. No.: 615,921

[30] Foreign Application Priority Data

Oct. 9, 1974 Switzerland ..... 13574/74

[52] U.S. Cl. ..... 58/86; 58/59

[51] Int. Cl.[2] ..... G04B 1/16

[58] Field of Search ..... 58/86, 83, 59, 87, 80, 58/73, 63, 7

[56] References Cited

UNITED STATES PATENTS

| | | | |
|---|---|---|---|
| 1,376,078 | 4/1921 | Carlstrom | 58/86 |
| 1,467,427 | 9/1923 | Freund | 58/86 |
| 3,673,791 | 7/1972 | Zaugg | 58/86 |

FOREIGN PATENTS OR APPLICATIONS

| | | | |
|---|---|---|---|
| 1,037,160 | 9/1953 | France | 58/86 |

*Primary Examiner*—Ulysses Weldon

*Attorney, Agent, or Firm*—Stevens, Davis, Miller & Mosher

[57] ABSTRACT

This invention relates to a driving device for mechanical timepiece movements, the device comprising a barrel-drum, a barrel-bridge, an arbor coaxial with the drum and pivoting in the bridge, a toothed ratchet-wheel secured to the arbor and disposed adjacent to the bridge, and a one-piece click comprising a rigid portion rotatable about the arbor between a locking position and an unlocking position, a resilient arm, and a beak disposed at a free end of the arm, the beak being adapted for engagement in the toothing of the ratchet-wheel.

6 Claims, 4 Drawing Figures

DRIVING DEVICE FOR MECHANICAL TIMEPIECE MOVEMENTS

BACKGROUND OF THE INVENTION

Figure 1:
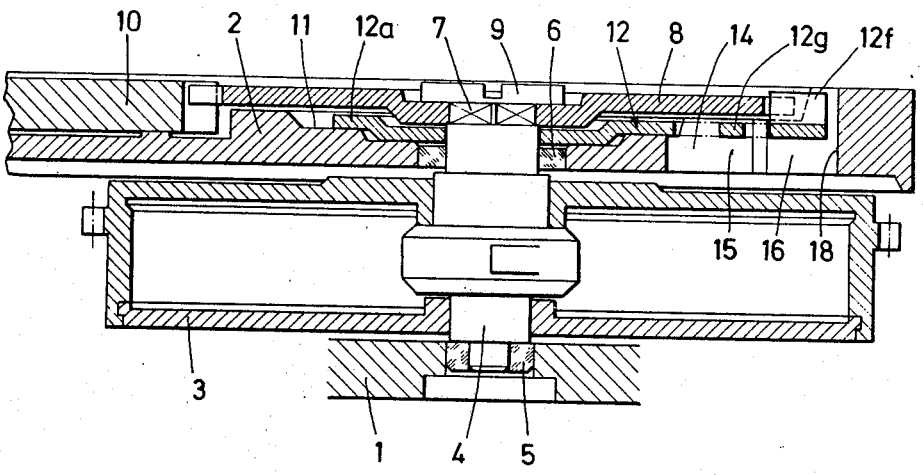

A device of this kind has already been proposed in French Pat. No. 1,037,160. Its click, being pivotable between the locking and unlocking positions, ensures a relatively great recoil when the mainspring has been fully wound, thus keeping the mainspring from working at a degree of wind close to the maximum, i.e., with a rapidly-varying torque. However, this known type of click is a relatively large-sized part, the resilient arm of which extends concentrically to the ratchet-wheel. A support element situated at the rearward end of the resilient arm, i.e., at the end connected to the rigid portion, cooperates with a fixed banking situated outside the peripheral limits of the ratchet-wheel so as to determine the unlocking position, while the outer portion of the click-beak cooperates with a sloping surface which causes it to engage in the toothing of the ratchet-wheel and ensures the locking position. The ratchet-wheel--and consequently the arbor--is locked in such a way that, because of this sloping surface, the click-beak is liable to jam in locking position. Furthermore, since the banking which determines the unlocking position is situated on a level with the toothing of the ratchet-wheel, the angle of displacement of the click, starting from the locking position, is limited by the presence of the crown-wheel, which is permanently engaged with the ratchet-wheel and causes it to be driven during manual winding.

Hence the recoil angle in the known device has a well-defined maximum which is on the order of about 20°. It is now known to be desirable, however, to use mainsprings which are very long and have a low torque so as to improve the running regularity of mechanical watch movements. The use of such springs also makes it desirable to produce clicks having a recoil greater than 20° and capable of reaching up to 300°.

The reduction in size of the known large-recoil clicks, a step facilitating the increase in the angle of recoil, must be accompanied by a reduction in the width of the resilient arm so that the latter may flex easily in unlocking position and, consequently, move the click-beak out of the toothing. Under these conditions, the resilient arm is a delicate element which is liable to be deformed either during fitting or in operation, under the influence of the torque to which it is subjected in locking position.

It is an object of this invention to provide improvements in driving devices of the kind initially mentioned so that they may be produced with a angle of recoil of up to 300° and with a smaller click which is easy to assemble and reliable in operation.

To this end, in the driving device according to the present invention, the bridge comprises a recess in which the click is disposed between the bridge and the ratchet-wheel, and the click further comprises a support element disposed at the free end of the resilient arm and situated within the peripheral limits of the ratchet-wheel, the recess having sides comprising, for determining the locking position, at least a first banking cooperating in the locking position with the support element and a second banking cooperating in the locking position with the beak.

Figure 2:
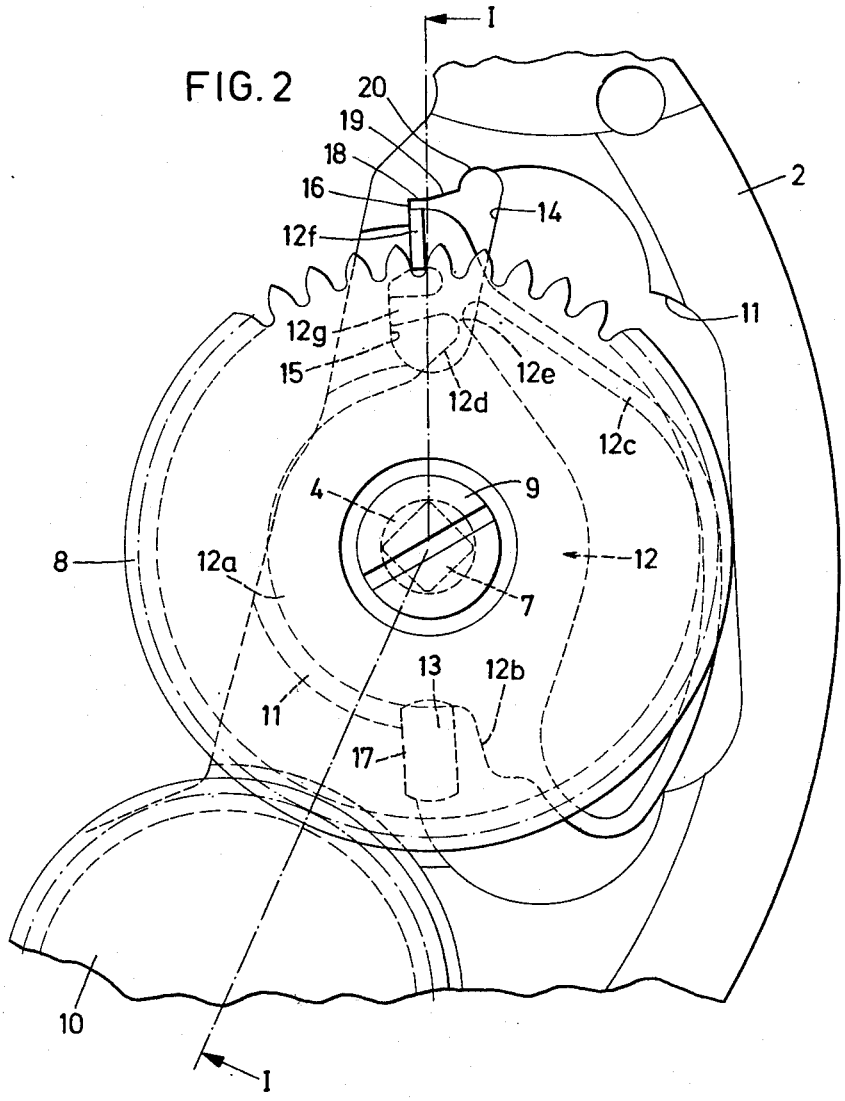
Figure 3:
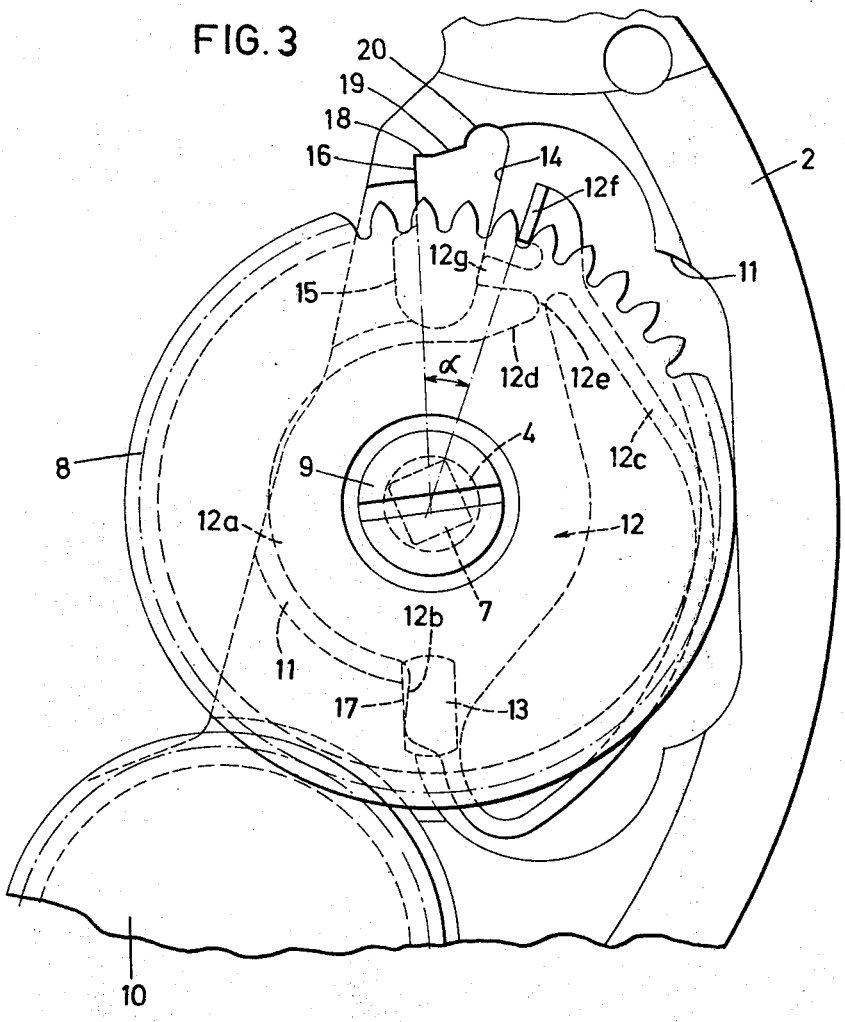
Figure 4:
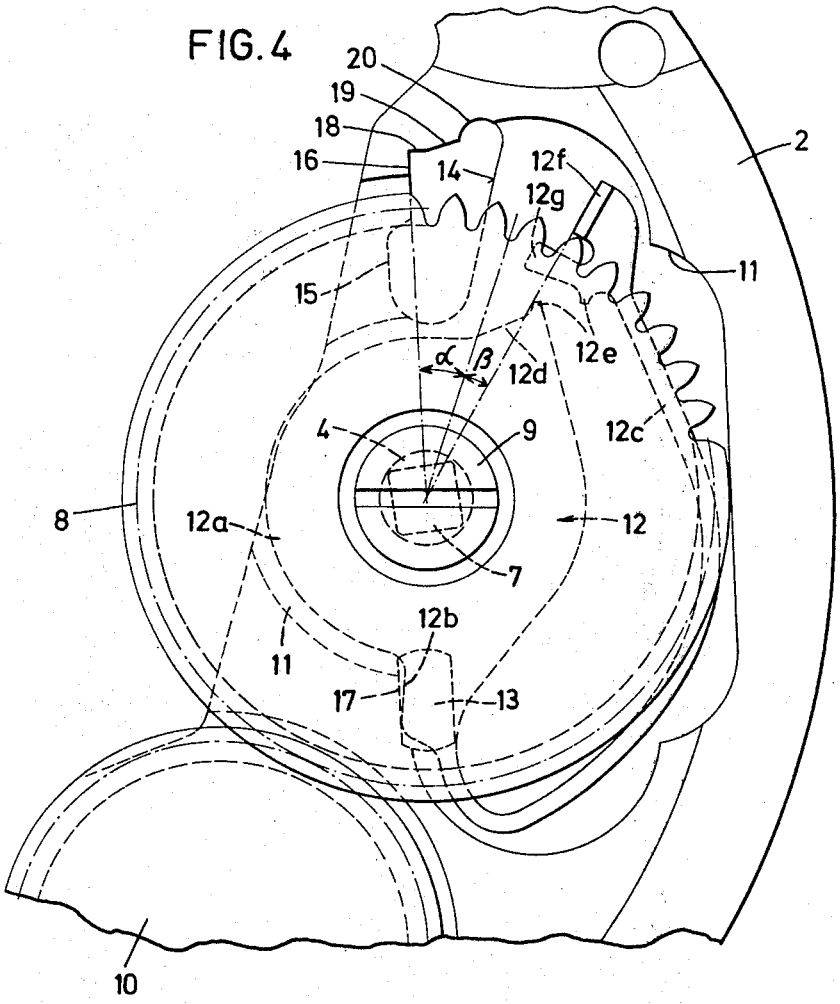

A preferred embodiment of the driving device according to the present invention will now be described in detail with reference to the accompanying drawings, in which:

FIG. 1 is a partial section, taken on the line I—I of FIG. 2, through a watch movement equipped with this embodiment of the driving device, FIG. 2 is a partial top plan view on a larger scale, showing the click placed in locking position at the time of fitting, and FIGS. 3 and 4 are views analogous to that of FIG. 2, showing the click in two respective operating positions and also the way in which it is put into operating condition.

FIG. 1 shows a plate 1 and a barrel-bridge 2 of a watch movement. Fitted between these two frame elements is a barrel 3, an arbor 4 of which pivots in bearings 5 and 6 which are integral with the plate 1 and the bridge 2, respectively. The arbor 4 extends beyond the bridge 2 and bears, on a square 7, a ratchet-wheel 8 secured by a screw 9. The ratchet-wheel 8 meshes with a crown-wheel 10 actuated by a winding mechanism (not shown). Surrounding the bearing 6, the barrel-bridge 2 has a specially shaped recess 11 in which a spring-click 12 is lodged. At two locations in the bottom of the recess 11 there are holes 13 and 14 (FIG. 2) passing completely through it.

As may be seen in FIG. 2, the spring-click 12 is made in one piece, from a part blanked out of a steel sheet. This part is fitted in the deepest portion of the recess 11. It comprises a rigid portion **12*a* blanked with a circular opening in the center, this opening being freely engaged on the arbor 4. The rigid portion 12*a* is circular in shape and has two extensions 12*b* and 12*d*. Extension 12*b* forms both a support element and the base of an arm 12*c* which extends along one edge of the rigid portion 12*a* at a certain distance away from it. The other end of the arm 12*c* is attached to the second extension 12*d* of the rigid portion 12*a* by a narrow strip 12*e*. The arm 12*c* further comprises a beak 12*f*, bent back perpendicular to the plane of the click 12 along a radial line, and a finger forming a support element 12*g* situated in the plane of the click 12. The shape of the click 12 as it is shown in FIG. 2 is that obtained upon blanking and bending of the part. The fitting of the click 12 is greatly simplified since it suffices to engage it on the arbor 4 and put the ratchet-wheel 8 in place, then to secure the wheel 8 by means of the screw 9. When the ratchet-wheel 8 is set in place, two of its teeth come to embrace the inner end of the bent portion 12*f*, so that at the time of fitting, the spring-click 12 is integral in rotation with the ratchet-wheel 8. The support element 12*g* comes to rest against a first banking 15 formed by a portion of the side of the recess 11 bordering on the hole 14. As may be seen in the drawing, the banking 15 extends almost radially. A second banking 16 is constituted by another element of the side of the recess 11 which also extends radially beyond the peripheral limit of the toothing of the wheel 8 and which cooperates with the outer end of the bent portion 12*f***.

After the device described has been fitted in place, the mainspring is wound for the first time. The wheel 8 is driven clockwise, as viewed in FIGS. 2, 3, and 4, so that owing to the engagement of the beak **12*f*, the spring-click 12 reaches the position shown in FIG. 3, where the support element 12*b* comes in contact with a banking 17 which also constitutes a portion of the side of the recess 11. The banking 17 is about directly opposite the bankings 15 and 16. In another embodiment, however, it might be situated elsewhere. Whatever its location, the spring-click 12 can rotate, between the positions shown in FIGS. 2 and 3, through an angle $\alpha$ (FIG. 3) which may be selected at will between 20° and 300°, for example. During this rotation, the spring-click 12** still acts like a rigid part.

As winding continues, the end of the arm 12*c* with the elements 12*g* and 12*f* is separated from the rigid portion 12*a* by breakage of the strip 12*e* after the position of FIG. 3 has been reached. This is the situation shown in FIG. 4, where the final position of the spring-click 12 may be seen. The click element 12*f* then disengages from the toothing of the wheel 8 owing to a resilient deflection of the arm 12*c* which takes place during an additional rotation of the wheel 8. The angle of this rotation is angle $\beta$ shown in FIG. 4. Hence the possible angle of recoil is the sum of the angles $\alpha + \beta$. As soon as the position shown in FIG. 4 has been reached, any additional rotation of the wheel 8 keeps the end of the resilient arm 12*c* and the element 12*f* in the unlocking position. As soon as the wheel 8 is released, on the other hand, one of its teeth catches the inner edge of the element 12*f*, and the spring-click 12 pivots with the wheel 8 until the locking position (FIG. 2) is reached.

In this position, the two support elements constituted by the bent portion 12*f* and the portion 12*g* of the spring-click 12 rest against the bankings 15 and 16 and are situated on either side of the click element constituted by the inner end of the bent portion 12*f*. Thus the wheel 8 is locked in a stable manner without any risk of deformation of the arm 12*c*.

In the embodiment described, the side of the recess 11, just adjacent to the banking 16, has a right-angle portion 18 which constitutes a retaining element, then an oblique portion 19 which constitutes an engagement element, then an arcuate portion 20 which constitutes a disengagement element. At the time of the recoil movement of the wheel 8, the outer edge of the element 12*f* catches in the disengagement element 20, so that the tooth which is driving the element 12*f* passes under its inner edge. The inner edge of the element 12*f* then engages in the following tooth-space and is pushed back into that space while the outer edge of the element 12*f* follows along the engagement element 19, then the retaining element 18, before coming to rest against the banking 16. The engagement of the element 12*f* between two teeth is also aided by the elasticity of the arm 12*c*. Thus the retaining element 18 acts as a bolt and prevents any untimely disengagement of the element 12*f* in the radial direction. The element 12*f* is, in effect, free since it is joined to the rigid portion 12*a* of the spring-click 12 only by the arm 12*c*, which is, by virtue of its construction, extremely flexible.

It will be noted that in the locking position, the spring-click 12 bolts and locks the wheel 8 in a totally reliable manner since a tooth of the wheel 8 rests against the inner edge of the element 12*f*, which constitutes the click element, while the outer end of the element 12*f* and the support element 12*g* both rest against bankings, viz., the banking 16 and 15, respectively, so that there can be no possible buckling or rotating movement of the head of bankings resilient arm 12*c*. Moreover, during the winding movement exerted on the ratchet-wheel 8, the spring-click 12 is first rotated with the wheel 8, as if it were a single rigid part, despite the fact that the narrow strip 12*e* is broken; and this rotation, during which the click element 12*f* remains engaged in the toothing of the wheel 8, continues until the support element 12*b* comes in contact with the banking 17. From then on, it is the elasticity of the arm 12*c* which comes into play, and the rotating movement of the wheel 8 brings about the disengagement of the element 12*f* from the toothing.

The click device described above presents numerous advantages which may be summarized as follows:

a. the rigid portion and the resilient portion of the spring-click are produced in one piece by blanking and bending;

b. the angle of recoil may be determined at will and may be of great amplitude, e.g., between 20° and 300°;

c. despite the large recoil, the deflection of the spring remains low, thus ensuring favorable operating conditions;

d. the fitting of the click requires neither a screw nor any other securing means;

e. the fabrication of the spring-click by blanking is greatly simplified inasmuch as the end of the resilient arm may be left joined to the rigid portion by a thin strip at the time of blanking. Thus the blanking operation yields a rigid part which is not apt to get caught on other parts during storage and preparatory to fitting. The free end of the resilient arm is not separated until the first winding of the mainspring, i.e., until after fitting has been completed. The fabrication of the barrel-bridge 2 likwise involves only simple operations. The stepped recess 11 may be produced by stamping and/or milling. The openings 13 and 14, the edges of which form the bankings 15 and 16, as well as the elements 18, 19, and 20, may be produced by blanking;

f. finally, a last advantage which may be mentioned is that with the same click, watches having different recoils may be produced, for the angle of recoil depends solely upon the relative locations of the bankings 15 and 17. Hence it is the fabrication of the barrel-bridge alone which determines the angle of recoil. This latter particularly presents a simplification in the programming and organization of the mass-production of watch movements.

What is claimed is:

1. A driving device for mechanical timepiece movements, said device comprising a barrel-drum, a barrel-bridge, an arbor coaxial with said drum and pivoting in said bridge, a toothed ratchet-wheel secured to said arbor and disposed adjacent to said bridge, and a one-piece click comprising a rigid portion rotatable about said arbor between a locking position and an unlocking position, a resilient arm, and a beak disposed at a free end of said arm, said beak being adapted for engagement in said toothing of said ratchet-wheel, wherein said bridge comprises a recess in which said click is disposed between said bridge and said ratchet-wheel, and said click further comprises a support element disposed at said free end of said resilient arm and situated within the peripheral limits of said ratchet-wheel, said recess having sides comprising, for determining said locking position, at least a first banking cooperating in said locking position with said support element and a second banking cooperating in said locking position with said beak.

2. A driving device in accordance with claim 1, further comprising a third banking formed by a portion of a said side of said recess and a second support element situated on said rigid portion within said peripheral limits, said third banking cooperating with said second support element for determining said unlocking position.

3. A driving device in accordance with claim 1, wherein said beak comprises a right-angle bend at said free end of said resilient arm, said bend having an outer portion cooperating with said first banking and an inner portion cooperating with said toothing of said ratchet-wheel.

4. A driving device in accordance with claim 3, further comprising a retaining element, an engagement element, and a disengagement element distributed along a said side of said recess and cooperating with said beak.

5. A driving device in accordance with claim 1, wherein said rigid portion and said free end of said resilient arm each comprise a portion of a broken strip.

6. A driving device in accordance with claim 1, wherein said recess in said barrel-bridge comprises at least two blanked apertures, said bankings being formed by portions of sides of said apertures.

* * * * *